US010434527B1

(12) United States Patent
Smitshoek

(10) Patent No.: US 10,434,527 B1
(45) Date of Patent: Oct. 8, 2019

(54) FLUID DISPENSING SYSTEM

(71) Applicant: EMM Holding BV, Zwolle (NL)

(72) Inventor: Tom Smitshoek, Zwolle (NL)

(73) Assignee: EMM Holding BV, Zwolle (NL)

( * ) Notice: Subject to any disclaimer, the term of this patent is extended or adjusted under 35 U.S.C. 154(b) by 0 days.

(21) Appl. No.: 15/725,719

(22) Filed: Oct. 5, 2017

(51) Int. Cl.

| | |
|---|---|
| ***B05B 9/03*** | (2006.01) |
| ***B65D 47/32*** | (2006.01) |
| ***B65D 25/20*** | (2006.01) |
| *B05B 7/24* | (2006.01) |

(52) U.S. Cl.
CPC ..... *B05B 9/03* (2013.01); *B65D 25/20* (2013.01); *B65D 47/32* (2013.01); *B05B 7/2408* (2013.01); *B05B 7/2478* (2013.01)

(58) Field of Classification Search
CPC ..... B05B 7/24; B05B 7/2402; B05B 7/2405; B05B 7/2408; B05B 7/241; B05B 7/2413; B05B 7/247; B05B 7/2478; B05B 7/2481; B05B 7/2483; B05B 9/03; B65D 25/20; B65D 47/32
See application file for complete search history.

(56) References Cited

U.S. PATENT DOCUMENTS

| | | | | |
|---|---|---|---|---|
| 2006/0102550 | A1* | 5/2006 | Joseph | B05B 7/2408 210/464 |
| 2007/0018016 | A1* | 1/2007 | Yechouron | B05B 7/2408 239/376 |
| 2008/0011879 | A1* | 1/2008 | Gerson | B05B 7/2408 239/337 |
| 2013/0001322 | A1* | 1/2013 | Pellegrino | B05B 7/2408 239/302 |
| 2016/0303594 | A1* | 10/2016 | Nyaribo | B05B 7/2408 |

* cited by examiner

*Primary Examiner* — Darren W Gorman
(74) *Attorney, Agent, or Firm* — Miller, Matthias & Hull LLP

(57) ABSTRACT

A fluid dispensing system may comprise a fluid container configured to contain paint. The fluid container may have a bottom end, an open upper rim, and a sidewall extending between the bottom end and the open upper rim. The fluid dispensing system may further comprise a lid configured to connect to the open upper rim of the fluid container, and the lid may have a connector configured to connect to a paint spray gun. The fluid dispensing system may further comprise a container holder having a cavity configured to receive the fluid container therein. The container holder may have a bottom end, an upper rim, and a sidewall extending between the bottom end and the upper rim. The fluid dispensing system may be configured to dispense the fluid by a gravity feed mechanism.

12 Claims, 5 Drawing Sheets

FLUID DISPENSING SYSTEM

FIELD

The present disclosure generally relates to fluid dispensing systems and, more specifically, to fluid dispensing systems including a fluid container, a lid, and a container holder configured to prevent damage to the fluid container when the lid is connected to the fluid container.

BACKGROUND

Fluid dispensing systems may be used to dispense a fluid, such as a paint, onto target surfaces. For example, a fluid dispensing system may be used for spray coating or spray painting surfaces in automotive, construction, part manufacturing, and other applications. Such systems may include a fluid container that holds the fluid and a lid that couples to the fluid container. The lid may be configured to connect to a fluid dispensing device, such as a spray gun. In some designs, the fluid may be dispensed through the dispensing device by a gravity feed mechanism in which the fluid dispensing system is inverted so that the fluid container is positioned above the dispensing device, allowing the fluid to flow from the fluid container to the dispensing device under the influence of gravity.

While effective, during user assembly of the fluid dispensing system, the fluid container may subject to breaking or cracking if the lid is connected the container in an incorrect manner. Thus, there is a need for improved designs for such fluid dispensing systems.

SUMMARY

In accordance with one aspect of the present invention, a kit for a fluid dispensing system is disclosed. The kit may comprise a fluid container configured to hold a fluid. The fluid container may have an open upper rim, a closed bottom end, and a sidewall extending between the closed bottom end and the open upper rim. The kit may further comprise a lid configured to connect to the open upper rim of the fluid container, and the lid may have a connector configured to connect to a fluid dispensing device. The kit may further comprise a container holder configured to receive the fluid container upon insertion of the fluid container therein. The container holder may be configured to prevent damage to the fluid container when the lid is connected to the open upper rim of the fluid container.

In accordance with another aspect of the present invention, a container holder for a fluid container of a fluid dispensing system is disclosed. The fluid dispensing system may include the fluid container configured to contain a fluid, and the fluid container may have an open upper rim, a bottom end, and a sidewall extending between the bottom end and the open upper rim. The fluid dispensing system may further include the container holder and a lid configured to connect to the open upper rim of the fluid container. The container holder may comprise a bottom end, an upper rim, and an upper lip surrounding the upper rim and extending radially outward from the upper rim with respect to a longitudinal axis of the container holder. The container holder may further comprise a sidewall extending between the bottom end and the upper rim. The sidewall may define a cavity for receiving the fluid container therein. The container holder may be configured to prevent damage to the fluid container when the lid is connected to the fluid container.

In accordance with another aspect of the present invention, a paint dispensing system is disclosed. The paint dispensing system may comprise a fluid container configured to contain paint. The fluid container may have a bottom end, an open upper rim, and a sidewall extending between the bottom end and the open upper rim. The paint dispensing system may further comprise a lid configured to connect to the open upper rim of the fluid container, and the lid may have a connector configured to connect to a paint spray gun. The paint dispensing system may further comprise a container holder having a cavity configured to receive the fluid container therein. The container holder may have a bottom end, an upper rim, and a sidewall extending between the bottom end and the upper rim. The paint dispensing system may be configured to dispense the paint by a gravity feed mechanism.

It should be understood that the drawings are not necessarily drawn to scale. It is to be further appreciated that the following detailed description is merely exemplary in nature and is not intended to limit the invention or the application and uses thereof. Hence, although the present disclosure is, for convenience of explanation, depicted and described as certain illustrative embodiments, it will be appreciated that it can be implemented in various other types of embodiments and in various other systems and environments.

DETAILED DESCRIPTION

Figure 1:
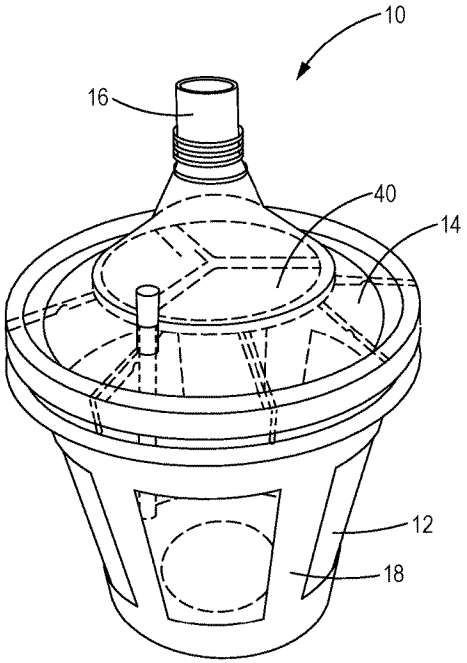
FIG. 1 is a perspective view of a fluid dispensing system, constructed in accordance with the present disclosure.
Figure 5:
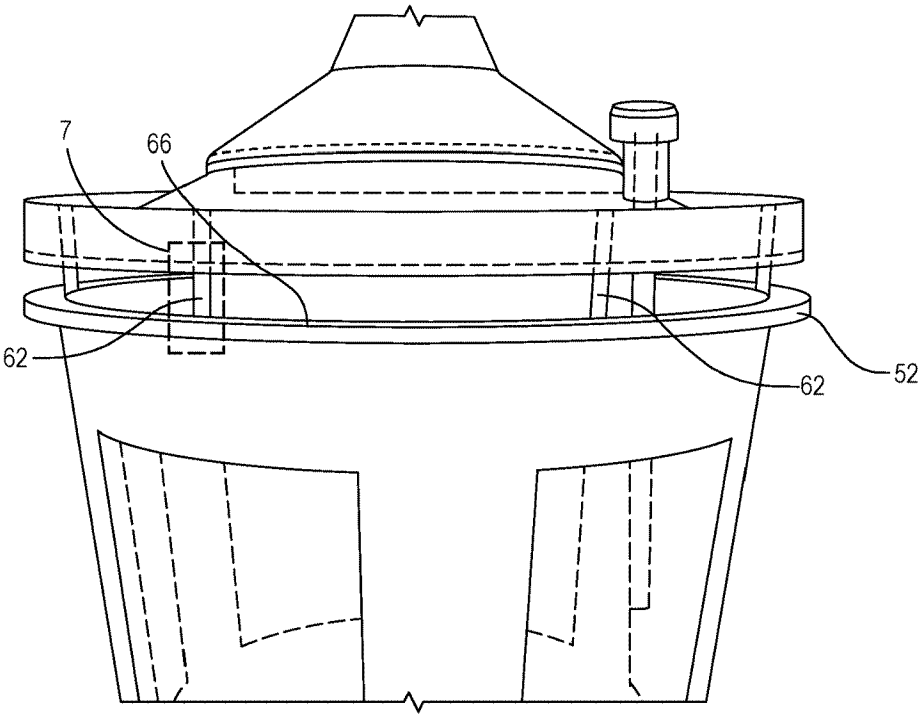
FIG. 5 is a side view of the container holder assembled with the fluid container, illustrating ribs of the fluid container engaged with the container holder, constructed in accordance with the present disclosure.
Figure 4:
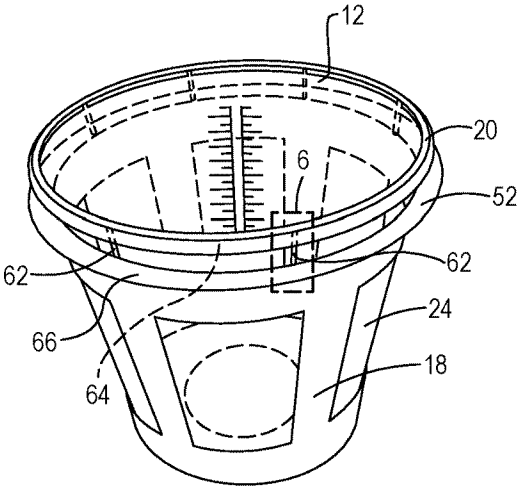
FIG. 4 is a perspective view of the container holder assembled with the fluid container of the fluid dispensing system, constructed in accordance with the present disclosure.
Figure 7:
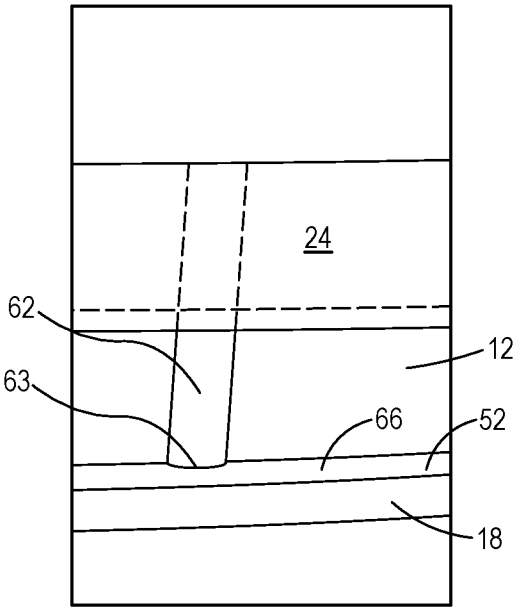
FIG. 7 is an expanded view of detail 7 of FIG. 5, constructed in accordance with the present disclosure.
Figure 6:
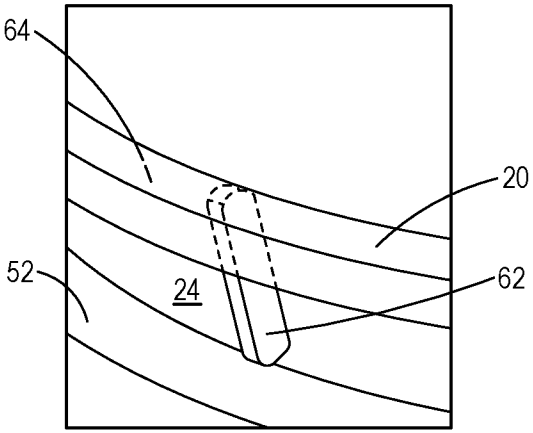
FIG. 6 is an expanded view of detail 6 of FIG. 4, constructed in accordance with the present disclosure.

Referring now to the drawings, and with specific reference to FIG. 1, a fluid dispensing system 10 is shown. The fluid dispensing system 10 may be used to dispense (e.g., spray, deposit) a fluid onto a surface. For example, the fluid dispensing system 10 may be used to apply a coating or paint onto a target surface for a range of applications, including automotive applications, part manufacturing, part repair, and various other industrial applications. Although not limited to certain types of paints, the fluid dispensing system 10 may be well-adapted for applying 2K paints or waterborne paints onto surfaces. As used herein, a 2K paint is a paint that requires mixing with a hardener, catalyst, or activator.

The fluid dispensing system 10 may generally include a cup-shaped fluid container 12 for holding the fluid to be dispensed, and a lid 14 that connects to the fluid container 12. The lid 14 may have a connector 16 configured to connect to a fluid dispensing device, such as a spray gun or a paint spray gun. In addition, the fluid dispensing system 10 may further include a container holder 18 that receives the fluid container 12 therein. As explained further below, the container holder 18 may structurally reinforce the fluid container 12 and prevent breaking or cracking of the fluid container 12 should the lid 14 be connected to the fluid container 12 with too much pressure or in an incorrect manner. The fluid dispensing system 10 may dispense the fluid by a gravity feed mechanism in which the fluid dispensing system 10 is inverted so that the fluid flows from the fluid container 12 to the fluid dispensing device (e.g., spray gun) under the influence of gravity for application to the target surface. It is noted here that the fluid dispensing system 10 disclosed herein is an improvement of the Colad Snap Lid System®, in which the container holder 18 is provided to prevent damage of the fluid container 12 when the lid 14 connected to the container 12. Alternatively, the fluid dispensing system 10 may dispense the fluid by a pressure feed mechanism, in which case the fluid dispensing system 10 need not be inverted.

Figure 2:
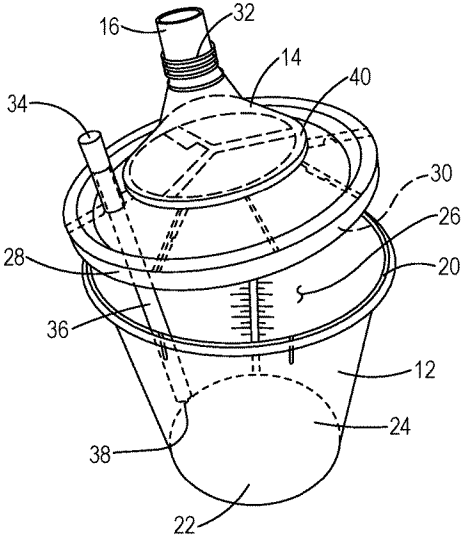
FIG. 2 is a perspective view of a fluid container and a lid of the fluid dispensing system, constructed in accordance with the present disclosure.

Turning to FIG. 2, structural details of the fluid container 12 and the lid 14 will now be described. The fluid container 12 may have an annular open upper rim 20, a closed bottom end 22, and a sidewall 24 extending between the closed bottom end 22 and the open upper rim 20. The bottom end 22 of the fluid container 12 may have a smaller diameter than the open upper rim 20, giving the fluid container 12 a frustoconical shape. In other designs, however, the fluid container 12 may other shapes such as, but not limited to, cylindrical, cubical, or conical shapes. The sidewall 24 may define a cavity 26 for receiving the fluid. The fluid container 12 may be formed from a transparent material, such as a transparent plastic material, to permit viewing of the fluid (e.g., paint, etc.) contained therein.

The lid 14 may include a lower rim 28 having an annular receiver 30 that receives the open upper rim 20 of the fluid container 12 therein when the lid 14 is coupled to the fluid container 12. The connector 16 of the lid 14 may be centrally located on the lid 14 and may consist of a raised port 32 configured to attach to the fluid dispensing device. In other arrangements, the connector 16 may be offset with respect to the center of the lid 14. The lid 14 may further include a ventilation system 34 having a ventilation tube 36 that extends through the lid 14 and into the fluid container 12 for venting the fluid container 12 as the fluid is being dispensed. An end 38 of the ventilation tube 36 in the fluid container 12 may be positioned above the fluid level when the fluid dispensing system 10 is inverted, allowing the tube 36 to equilibrate the air pressure inside the container 12 with the air pressure outside of the container 12. In some arrangements, the ventilation tube 36 may optionally include a valve (not shown) that opens when a significant pressure difference exists between the inside and the outside of the fluid container 12. Positioning of the end 38 of the ventilation tube 36 above the fluid level also ensures that the fluid does not inadvertently leak out of the fluid container 12 through the tube 36 as the fluid is being dispensed. The lid 14 may also include a filter/strainer 40 that filters out particulates in the fluid prior to delivery to the fluid dispensing device/spray gun (also see FIG. 1). The filter 40 may have a 90, 130, 190, or 280 micrometer pore size, although other pore sizes may also be used. Like the fluid container 12, the lid 14 may also be formed from a transparent material, such as a transparent plastic material. In some designs, however, the fluid container 12 and/or the lid 14 may be formed from and non-transparent and/or non-plastic material.

Figure 3:
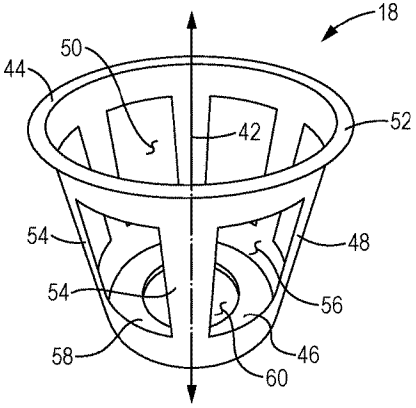
FIG. 3 is a perspective view of a container holder of the fluid dispensing system shown in isolation, constructed in accordance with the present disclosure.

The container holder 18 is shown in isolation in FIG. 3. The container holder 18 may include an annular upper rim 44, a bottom end 46, and a sidewall 48 extending between the upper rim 44 and the bottom end 46 to define a cavity 50 for receiving the fluid container 12 therein. Like the fluid container 12, the container holder 18 may be cup-shaped, albeit with a slightly larger diameter than the fluid container 12 to allow insertion of the fluid container 12 therein. The bottom end 46 may have a smaller diameter than the upper rim 44, giving the container holder 18 a frustoconical shape that mirrors the shape of the fluid container 12. In other arrangements, the container holder 18 may have alternative shapes such as, but not limited to, cylindrical, cubical, or conical shapes. Extending radially outward from the upper rim 44 with respect to a central longitudinal axis 42 of the holder 18 may be an upper lip 52 that engages with the fluid container 12 (see further details below).

As shown in FIG. 3, the sidewall 48 of the container holder 18 may be formed from a plurality of bars 54 separated by open gaps 56. The bars 54 may extend vertically and at an angle between the bottom end 46 and the upper rim 44 of the container holder 18. Although six bars 54 are shown in FIG. 3, it will be understood that other number of bars may be used in alternative designs of the container holder 18. Advantageously, the open gaps 56 between the bars 54 may permit light to pass therethough to allow viewing of the fluid held in the fluid container 12 to facilitate mixing of the fluid/paint by the user. In other arrangements, however, the sidewall 48 of the container holder 18 may have a nearly solid or solid construction with or without open gaps to allow viewing of the fluid. In addition, the bottom end 46 of the container holder 18 may include a lower lip 58 surrounding a central aperture 60, with the lower lip 58 extending radially inward to the aperture 60 with respect to the longitudinal axis 42. The aperture 60 may be centrally located at the bottom end 46 with the longitudinal axis 42 running through a center of the aperture 60, although the aperture 60 may be offset with respect to the longitudinal axis 42 in alternative designs. In yet other arrangements, the bottom end 46 of the container holder 18 may have a solid construction without holes. The container holder 18 may be formed from a suitable plastic material, such as polypropylene (PP) plastic, although other suitable materials may also be used in some circumstances. The holder 18 may be more structurally rigid than the container 12 to provide structural reinforcement to the container 12 when the lid 14 is coupled to the container 12. The enhanced rigidity of the holder 18 may be achieved by using more solid and/or thick bars 54.

Referring now to FIGS. 4-7, the assembly of the fluid container 12 with the container holder 18 is shown in greater detail. Notably, the fluid container 12 may have a plurality of vertically extending ribs 62 that project from a bottom edge 64 of the open upper rim 20 and the sidewall 24 (see FIGS. 4 and 6). Each of the ribs 62 may have a bottom surface 63 that engages with the upper lip 52 of the container holder 18 by resting on an upper surface 66 of the upper lip 52 (see FIGS. 5 and 7). Advantageously, this engagement distributes pressure to the container holder 18 (and away from the fluid container 12) when the lid 14 is placed on the fluid container 12, thereby reducing damage to the fluid container 12. The ribs 62 may extend along a small fraction of the sidewall 24, such as less than 10%, or less than 5%, of the length of the sidewall 24. In addition, the distance between the bottom end 22 of the container 12 and the rib 62 may be equal to or less than the distance between the bottom end 22 of the container 12 and the upper rim 20 of the container 12.

Figure 8:
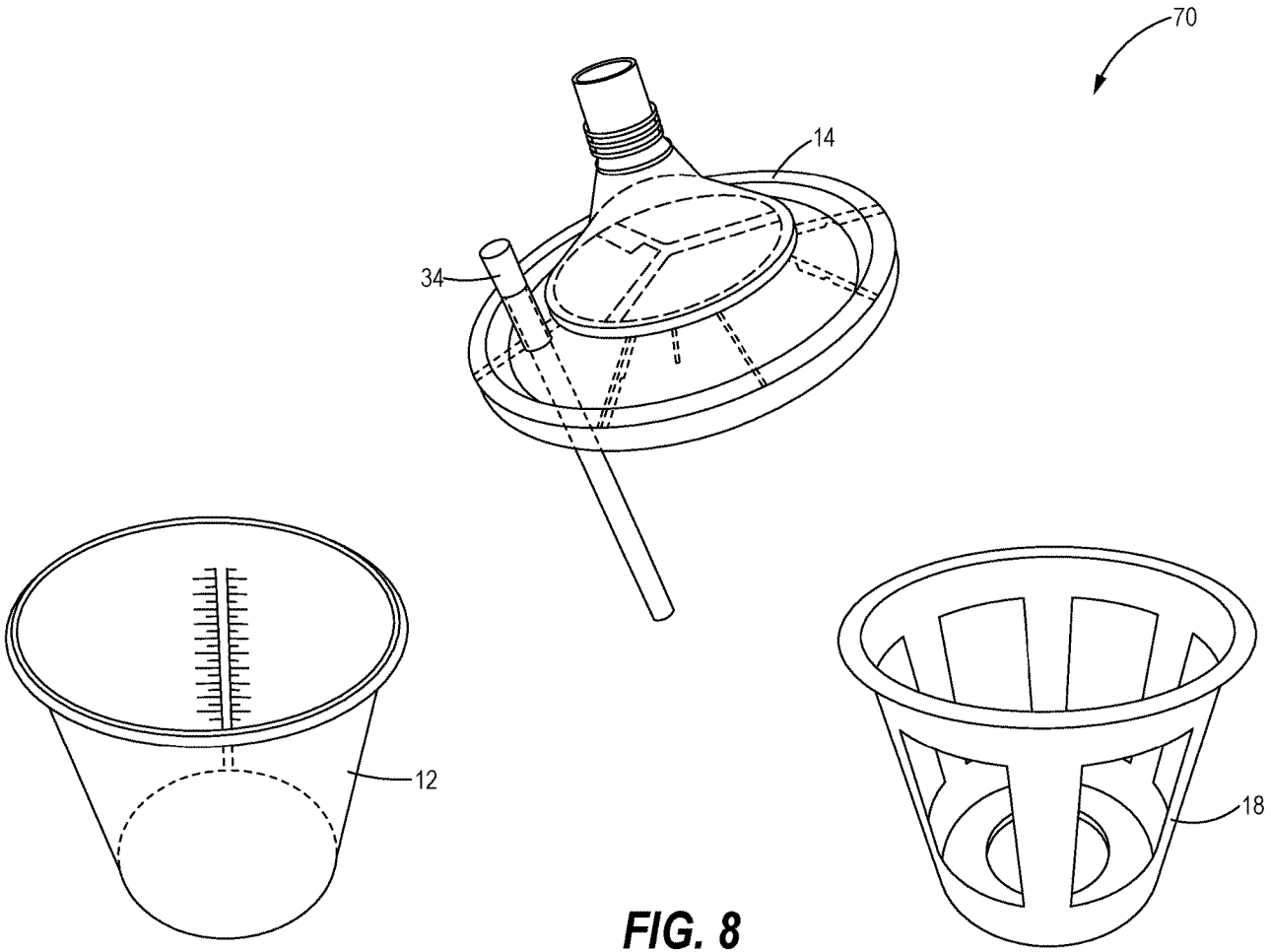
FIG. 8 is a perspective view, illustrating components of a kit for user assembly of the fluid dispensing system, constructed in accordance with the present disclosure.

As shown in FIG. 8, the components of the fluid dispensing system 10 may be provided separately in a kit 70, allowing a user to assemble the fluid dispensing system 10 when needed. At a minimum, the kit 70 for the fluid dispensing system 10 may include the fluid container 12, the lid 14 with the ventilation system 34, and the container holder 18. The ventilation system 34 may be provided pre-assembled with the lid 14, or may be provided separately for user assembly with the lid 14. In some arrangements, the kit 70 may further include additional components not shown such as, but not limited to, a spray gun, a fluid/paint mixer, filters, and replacement parts.

Figure 9:
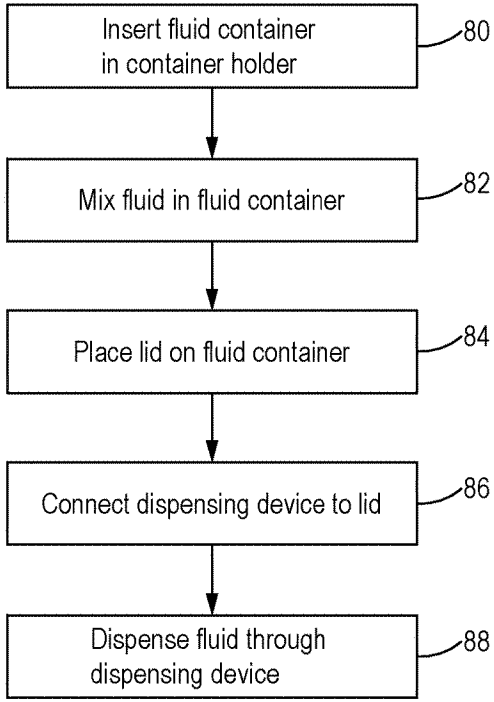
FIG. 9 is a flowchart of a series of steps that may be involved in assembling the fluid dispensing system, in accordance with a method of the present disclosure.

Turning now to FIG. 9, a series of steps that may be involved in assembling the fluid dispensing system 10 is shown. Beginning at a first block 80, the fluid container 12 may be inserted in the container holder 18 such that the ribs 62 of the fluid container 12 engage the upper lip 52 of the container holder 18. The fluid may then be added to the fluid container 12 and mixed therein according to a next block 82. For instance, if the fluid is paint, the paint (and, optionally, other additives) may be mixed in the container 12 with a mixing device, such as a suitable stirrer or spatula. The open gaps 56 between the bars 54 of the container holder 18 may permit the user to view the fluid in the fluid container 12 to facilitate mixing.

According to a next block 84, the lid 14 may be placed on the fluid container 12 by coupling the lower rim 28 of the lid 14 to the open upper rim 20 of the fluid container 12. With the fluid container 12 reinforced by the container holder 18, breaking or cracking of the fluid container 12 may be prevented during the block 84. At a next block 86, the dispensing device (e.g., the spray gun) may be connected to the connector 16 of the lid 14. The fluid may then be dispensed from the fluid dispensing system 10 through the dispensing device according to a block 88. Specifically, the block 88 may involve inverting the fluid dispensing system 10, allowing the fluid to out of the fluid container 12 and to the dispensing device/spray gun under the influence of gravity.

Figure 10:
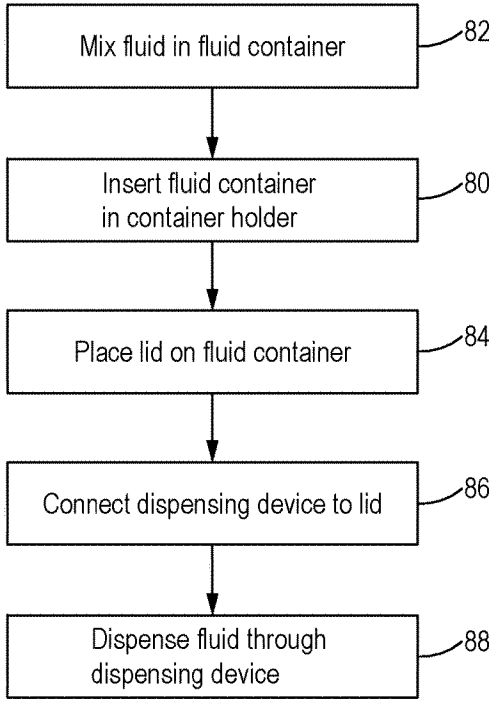
FIG. 10 is a flowchart of a series of steps that may be involved in assembling the fluid dispensing system, in accordance with another method of the present disclosure.

An alternative method for assembling the fluid dispensing system 10 is shown in FIG. 10. The method of FIG. 10 is identical to the method of FIG. 9, except that the fluid is mixed in the fluid container 12 (block 82) prior to the assembly of the fluid container 12 with the container holder 18 (block 80).

INDUSTRIAL APPLICABILITY

In general, it can therefore be seen that the technology disclosed herein has industrial applicability in a variety of settings requiring the application of a fluid such as a coating or paint to target surfaces. The fluid dispensing system disclosed herein includes a fluid container, a lid configured to couple to a dispensing device, and a container holder that receives the fluid container therein and prevents breaking or cracking of the fluid container when the lid is connected to the fluid container. As disclosed herein, the container holder is positioned outside of the fluid container and is configured to provide structural reinforcement to the fluid container, thereby improving the ability of the fluid container to structurally withstand pressure caused by coupling the lid to the fluid container. Notably, the engagement of the upper lip of the container holder with the ribs of the fluid container allows the pressure to be directed to the container holder (and away from the fluid container) when the lid is coupled to the fluid container, thereby dividing the pressure between the fluid container and the container holder. As such, any resulting structural damage to the fluid container is considerably reduced or eliminated.

The technology disclosed herein may find applicability in a wide range of areas such as, but not limited to, automotive, construction, part repair, and part manufacturing applications.

What is claimed is:

1. A kit for a fluid dispensing system, the kit comprising:

a fluid container configured to hold a fluid, the fluid container having an open upper rim, a closed bottom end, and a sidewall extending between the closed bottom end and the open upper rim;

a lid having a lower rim configured to directly receive and extend over the open upper rim of the fluid container, the lid having a connector configured to connect to a fluid dispensing device; and a container holder including an upper annular rim, a bottom end, and a sidewall extending between the upper annular rim and the bottom end to define a cavity configured to receive the fluid container, the sidewall being configured to engage the sidewall of the fluid container thereby to structurally reinforce the fluid container, wherein an upper lip extends radially outwardly from the upper annular rim; and a plurality of vertically extending ribs formed integrally with the fluid container, each of the plurality of vertically extending ribs projecting from a bottom edge of the open upper rim and the sidewall of the fluid container and defining a bottom surface, wherein each of the plurality of vertically extending ribs is sized so that the bottom surface of each of the plurality of vertically extending ribs engages the upper lip of the container holder when the fluid container is inserted into the cavity of the container holder, so that the plurality of vertically extending ribs directly oppose a force applied to the lid as the lid is connected to the fluid container.

2. The kit of claim 1, wherein each of the plurality of vertically extending ribs extends along less than 10% of a length of the sidewall of the fluid container.

3. The kit of claim 1, wherein the sidewall of the container holder includes a plurality of bars separated by open gaps.

4. The kit of claim 3, wherein the fluid container is transparent to permit viewing of the fluid contained in the fluid container.

5. The kit of claim 4, wherein the gaps between the bars of the container holder permit viewing of the fluid contained in the fluid container when the fluid container is inserted in the container holder.

6. The kit of claim 5, wherein the container holder is formed from polypropylene (PP) plastic.

7. The kit of claim 5, wherein the bottom end of the container holder includes a lower lip surrounding a central aperture, the lower lip extending radially inward with respect to a longitudinal axis of the container holder.

8. The kit of claim 5, wherein the fluid is a paint.

9. The kit of claim 8, wherein the fluid dispensing device is a spray gun.

10. The kit of claim 9, wherein the lid includes a ventilation tube extending therethrough, the ventilation tube being configured to vent the fluid container when the fluid is dispensed from the fluid dispensing system.

11. A paint dispensing system, comprising:

a fluid container configured to contain paint, the fluid container having a bottom end, an open upper rim, and a sidewall extending between the bottom end and the open upper rim;

a lid having a lower rim configured to directly receive and extend over the open upper rim of the fluid container, the lid having a connector configured to connect to a paint spray gun; and a container holder having a bottom end, an upper annular rim, and a sidewall extending between the bottom end and the upper annular rim to define a cavity configured to receive the fluid container, the sidewall being configured to engage the sidewall of the fluid container thereby to structurally reinforce the fluid container, wherein an upper lip extends radially outwardly from the upper annular rim; and a plurality of vertically extending ribs formed integrally with the fluid container, each of the plurality of vertically extending ribs projecting from a bottom edge of the open upper rim and the sidewall of the fluid container and defining a bottom surface, wherein each of the plurality of vertically extending ribs is sized so that the bottom surface of each of the plurality of vertically extending ribs engages the upper lip of the container holder when the fluid container is inserted into the cavity of the container holder, so that the plurality of vertically extending ribs directly oppose a force applied to the lid as the lid is connected to the fluid container;

wherein the paint dispensing system is configured to dispense the paint by a gravity feed mechanism.

12. The paint dispensing system of claim 11, wherein the sidewall of the container holder includes a plurality of vertical bars separated by open gaps.

* * * * *